United States Patent [19]

Nagai et al.

[11] Patent Number: 4,954,694

[45] Date of Patent: Sep. 4, 1990

[54] COOKING OVEN HAVING FUNCTION TO AUTOMATICALLY CLEAN SOILS ATTACHED TO INNER WALLS THEREOF

[75] Inventors: Takeshi Nagai; Hiroshi Fukuda; Masahiko Itoh, all of Nara; Takao Shitaya, Yamato Kouriyama, all of Japan

[73] Assignee: Matsushita Electric Industrial Co., Ltd., Japan

[21] Appl. No.: 303,882

[22] Filed: Jan. 30, 1989

[51] Int. Cl.[5] ..... H05B 1/02

[52] U.S. Cl. ..... 219/413; 219/393; 219/396

[58] Field of Search ..... 219/413, 412, 391, 392, 219/10.55 B, 497, 501, 395–398, 393

[56] References Cited

U.S. PATENT DOCUMENTS

| | | | |
|---|---|---|---|
| 3,121,158 | 2/1964 | Hurko . | |
| 3,428,434 | 2/1969 | Hurko . | |
| 3,536,457 | 10/1970 | Henderson . | |
| 4,292,501 | 9/1981 | Maitenaz | 219/413 |
| 4,311,895 | 1/1982 | Tanabe | 219/10.55 B |
| 4,336,433 | 6/1982 | Yokozeki | 219/10.55 B |
| 4,379,964 | 4/1983 | Kanazawa | 219/413 |
| 4,481,404 | 11/1984 | Thomas | 219/413 |
| 4,507,529 | 3/1985 | Smith | 219/10.55 B |
| 4,587,393 | 5/1986 | Ueda | 219/10.55 B |

FOREIGN PATENT DOCUMENTS 55-75133 6/1980 Japan .

*Primary Examiner*—Teresa J. Walberg
*Attorney, Agent, or Firm*—Lowe, Price, LeBlanc, Becker & Shur

[57] ABSTRACT

A self-cleaning type cooking oven with a cooking chamber which has a function to pyrolytically eliminate food soils accumulated on walls of the cooking chamber. The cooking oven includes a heater for supplying heat into the cooking chamber so as to allow to pyrolytically degrade the food soils and an exhausting passage coupled to the cooking chamber to exhaust gases generated due to the pyrolytical degradation to an ambient atmosphere. In the exhausting passage is provided an oxidizing catalyst which oxidizes the gases introduced thereinto for exhausting and also provided a gas sensor to detect a gas component therearound. Also included in the cooking oven is a heat control unit electrically connected to the heater for controlling heat supply into the cooking chamber, the heat control unit being responsive to a gas signal therefrom to determine a heating time period for chamber cleaning. With the temperature of the cooking chamber being kept at a predetermined cleaning temperature, the heat control unit samples the gas signal at a given time interval to detect a variation of amount of the gas component and detect an inflection point from decreasing to increasing or vice versa in the gas-component variation to determine the heating time period in conjunction with the inflection point, the food soils being substantially degraded by heating during the heating time period.

9 Claims, 5 Drawing Sheets

COOKING OVEN HAVING FUNCTION TO AUTOMATICALLY CLEAN SOILS ATTACHED TO INNER WALLS THEREOF

BACKGROUND OF THE INVENTION

The present invention relates to cooking ovens, and more particularly to a self-cleaning cooking oven which is capable of automatically eliminating food soils accumulated on its walls by a pyrolytic process at a high temperature.

Generally known as dislosed in U.S Pat. Nos. 3,428,434, 3,536,457 and 4,292,501 are cooking ovens such as electric ovens, gas ovens and convection microwave ovens which can not only be used for normal cookings but also can pyrolytically eliminate food soils attached to its walls during the normal cookings. The pyrolytic elimination can be effected with two processes: one process being to pyrolytically degrade food soils in a cooking chamber maintained at a high cleaning temperature more than 440° C. for one to four hours so as to generate smoke, odors and gases and the other process being to oxidize the smoke, odors and gases by an oxidizing catalyst disposed in an exhausting passage when the chamber atmosphere including the smoke, odors and gases is exhausted through the exhausting passage to an ambient atmosphere. Normally, the cleaning time is defined as an interval from the time whereat a heating starts to a time whereat the chamber temperature is cooled to about 300° C. due to heating stop after the chamber temperature is kept to the cleaning temperature, which is generally set to about 470° C., for a predetermined time period and, as disclosed in U.S. Pat. No. 3,121,158, based upon time control using a timer. The cleaning time depends upon the cleaning temperature and the degree of contamination and hence it can be shortened in response to increase in the cleaning temperature and is varied in accordance with the degree of contamination. However, the set cleaning temperature is generally varied by about ±30° C., i.e., in a range of 470±30° C., in the practical uses and the cleaning time necessary at the minimum cleaning temperature of 440° C. becomes longer by about 1.5 times than that necessary at the maximum cleaning temperature of 500° C. This shows the fact that difficulty is encountered to accurately determine the cleaning time for elimination of food soils.

In addition, as described above, the cleaning time greatly depends on the amount of food soils in practical uses. In the case of light food soils, the soil-elimination is sufficiently effected with the process wherein the chamber temperature is immediately cooled by stopping the heat supply to the cooking chamber after it arrives at the cleaning temperature. In this case, the cleaning time is to be about one hour (about ½ hour for heating-up and about ½ hour for cooling-off). On the other hand, in the case of heavy food soils, the chamber temperature is maintained at the cleaning temperature for about three hours. Here, the cleaning time is about four hours (about ½ hours for heating-up, about three hours for keeping the cleaning temperature and about ½ hours for cooling-off). However, in the practical uses the food contamination in the cooking chamber is frequently in the intermediate state therebetween and in this case it is difficult to accurately determine the cleaning time. This difficulty causes to take an excessive cleaning time for preventing unsufficient soil elimination, thereby consuming energy wastefully.

SUMMARY OF THE INVENTION

It is therefore an object of the present invention to provide a cooking oven with a self-ceaning function which is capable of automatically and appropriately determining the cleaning time irrespective of variation of the cleaning temperature and the degree of contamination in the cooking chamber.

According to the present invention, a self-cleaning type cooking oven includes a heater for supplying heat into a cooking chamber so as to allow to pyrolytically degrade food soils accumulated on walls of the cooking chamber and an exhausting passage coupled to the cooking chamber to exhaust gases generated due to the pyrolytical degaradation to an ambient atmosphere. In the exhausting passage is provided an oxidizing catalyst which oxidizes the gases introduced thereinto for exhausting and further provided a gas sensor to detect a gas component therearound. Also included in the cooking oven is a heat control unit electrically connected to the heater for controlling heat supply into the cooking chamber. One feature of the present invention is that the heat control unit is responsive to a gas signal therefrom to determine a heating time period for chamber cleaning and, with the temperature of the cooking chamber being kept at a predetermined cleaning temperature, the heat control unit samples the gas signal at a given time interval to detect a variation of amount of the gas component and detect an inflection point from decreasing to increasing or vice versa in the gas-component variation to determine the heating time period in conjunction with the inflection point, the food soils being substantially degraded by heating during the heating time period.

The present invention is based upon the following fact. That is, at the initial stage the food soils accumulated on the walls of the cooking chamber begin to be degraded to increase an amount of degraded products, oxidized products and consumed oxygen with the heating time. However, in an intermediate stage, there inversely decrease the amount of the degraded products, oxidized products and consumed oxygen because the amount of the food soils decreases with increase in the heating time due to a progress of pyrolytic degradations, and at the final state the food soils are completely degraded with a little residue and hence there are not generated the degraded products and oxidized products and no consumed oxygen. Thus, it is possible to determine a preferred heating time period by detecting the variation of the degraded products or consumed oxygen.

In accordance with the present invention, there is provided a self-cleaning type cooking oven having a function to pyrolytically eliminate food soils accumulated therein, said cooking, oven comprising: a cooking chamber; heating means for supplying heat into said cooking chamber so as to allow to pyrolytically degrade the food soils accumulated on walls of said cooking chamber; an exhausting passage coupled to said cooking chamber to exhaust gases generated due to the pyrolytical degaradation in said cooking chamber to an ambient atmosphere; an oxidizing catalyst provided in said exhausting passage to oxidize said gases passing therethrough; gas sensor means provided in said exhausting passage to detect a gas component therearound and arranged to generate a gas signal indicative of the amount of said gas component; and heat control means connected to said heating means for controlling supply of heat into said cooking chamber, said heat control means being responsive to said gas signal from said gas sensor means so as to determine a heating time period on the basis of the amount of said gas component indicated by said gas signal so that said cooking chamber is heated for said heating time period whereby the food soils accumulated on said walls of said cooking chamber are substantially degraded during said heating time period.

In accordance with the present invention, there is further provided a self-cleaning type cooking oven having a function to pyrolytically eliminate food soils accumulated therein, said cooking oven comprising: a cooking chamber; heating means for supplying heat into said cooking chamber so as to allow to pyrolytically degrade the food soils accumulated on walls of said cooking chamber; an exhausting passage coupled to said cooking chamber to exhaust gases generated due to the pyrolytical degaradation in said cooking chamber to an ambient atmosphere; an oxidizing catalyst provided in said exhausting passage to oxidize said gases passing therethrough; gas sensor means provided in said exhausting passage to detect a gas component therearound and arranged to generate a gas signal indicative of the amount of said gas component; temperature sensor means provided in said cooking chamber so as to generate a temperature signal indicative of a temperature of said cooking chamber; and heat control means electrically connected to said heating means for controlling supply of heat into said cooking chamber, said heat control means being responsive to said gas signal from said gas sensor means and said temperature signal from said temperature sensor means so as to maintain a temperature of said cooking chamber up to a predetermined cleaning temperature and to determine a heating time period of said cooking chamber for cleaning, said heat control means sampling said gas signal at a predetermined time interval to detect a variation of the amount of said gas component and detect an inflection point from decreasing to increasing or vice versa in the gas gas-component variation to determine said heating time period in correspondance with said inflection point.

In accordance with the present invention, there is still provided a self-cleaning type cooking oven having a function to pyrolytically eliminate food soils accumulated therein, said cooking oven comprising: a cooking chamber; heating means for supplying heat into said cooking chamber so as to allow to pyrolytically degrade the food soils accumulated on walls of said cooking chamber; an exhausting passage coupled to said cooking chamber to exhaust gases generated due to the pyrolytical degaradation in said cooking chamber to an ambient atmosphere; an oxidizing catalyst provided in said exhausting passage to oxidize said gases passing therethrough; gas sensor means provided in said exhausting passage to detect a gas component therearound and arranged to generate a gas signal indicative of the amount of said gas component; temperature sensor means provided in said cooking chamber so as to generate a temperature signal indicative of a temperature of said cooking chamber; and heat control means electrically connected to said heating means for controlling supply of heat into said cooking chamber, said heat control means being responsive to said gas signal from said gas sensor means and said temperature signal from said temperature sensor means so as to maintain a temperature of said cooking chamber up to a predetermined cleaning temperature and to determine a heating time period on the basis of the amount of said gas component indicated by said gas signal so that said cooking chamber is heated for said heating time period whereby the food soils accumulated on said walls of said cooking chamber is substantially degraded during said heating time period, said heat control means including: first means responsive to said gas signal at a predetermined time interval so as to generate a signal indicative of variation of the amount of said gas component; second means for detecting a changing point from increasing to decreasing or vice versa in the variation of the amount of said gas component on the basis of said variation signals from said first means; and third means for detecting a second changing point from decreasing to increasing or vice versa in the variation of said gas component after the detection of said first-mentioned changing point, wherein said heat control means determines said heating time period on the basis of said second changing point detected by said third means.

BRIEF DESCRIPTION OF THE DRAWINGS

The present invention will be described in further detail with reference to the accompanying drawings, in which.

DETAILED DESCRIPTION OF THE INVENTION

Figure 1:
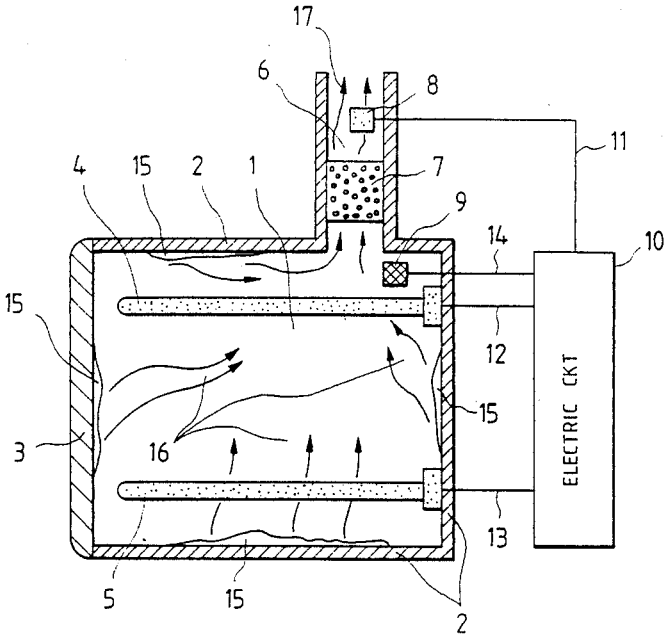
FIG. 1 is a cross-sectional view showing a cooking oven according to an embodiment of the present invention.

Referring now to FIG. 1, there is illustrated a cooking oven according to an embodiment of the present invention which is shown as comprising a cooking chamber 1 surrounded with walls 2 and a front door 3, a heating means comprising upper and lower electric heating devices 4, 5 respectively disposed in the cooking chamber 1 so as to extend from one wall 2 in substantial parallel to each other and an exhausting passage 6 coupled to the cooking chamber 1 to exhaust an atmosphere therein to the ambient atmosphere. In the exhausting passage 6 is provided an oxidizing catalyst 7 which is made of microscopic particles of platinum, palladium, rhodium and the like. Also included in the cooking oven is a control means comprising an electric circuit 10 connected through leads 12, 13 to the upper and lower electric heating devices 4, 5 which in turn supply heat into the cooking chamber 1 under control of the electric circuit 10. The electric circuit 10 is also connected electrically through leads 11, 14 to various sensors such as a gas sensor 8 and a chamber temperature sensor 9 so as to input information for cooking and heating control. The gas sensor 8 is provided at the downstream side of the oxidizing catalyst in the exhausting passage 6 and the chamber temperature sensor 9 is encased in the cooking chamber 1 to detect the temperature therein.

When as shown in FIG. 1 food soils 15 are accumulated on the walls 2 and the inner surface of the front door 3 during normal cookings, for elimination, the chamber temperature starts to be increased from a room temperature up to the cleaning temperature of about 470° C., for example. Under the condition that tarred salad oils of about 1 g and about 20 g were applied on the walls 2 at random as light food soils 15 and heavy food soils 15, respectively, when the chamber temperature substantially reaches more-than 400° C., the food soils 15 begin to be degraded so as to generate degraded products 16 including smoke, odors and gases such as methane, ethane, water vapor, carbon monooxide, carbon dioxide, hydrocarbon and others. The chamber atmosphere including the degraded products 16 is exhausted through the exhausting passage 6 to an ambient atmosphere. At this time, in response to initial contact of the chamber atmosphere with the oxidizing catalyst 7, the degraded products 16 are oxidized thereby to be converted to water vapor and carbon dioxide. As a result, a cleaned atmosphere 17 not including the dirty degraded products 16 is exhausted to the ambient atmosphere. The gas sensor 8, disposed at the downstream side of the oxidizing catalyst 7, detects a gas component in the cleaned atmosphere 17. Here, it is preferable that as the gas sensor 8 is used a humidity sensor, a carbon dioxide sensor or an oxygen sensor, because there are vapor and carbon dioxide produced due to the oxidation of the degraded products 16 in the cleaned atmosphere 17 and the oxygen concentration of the cleaned atmosphere 17 is reduced by oxygen consumption due to the oxidation.

The gas sensor 8 is preferably placed at a position in the exhausting passage 6 where the atmosphere temperature is lower than 300° C. Generally, the atmosphere temperature in the exhausting passage 6 is ranged from the maximum temperature of about 600° C. or less near the oxidizing catalyst 7 resulting from the combustion heat of the degraded products 16 to the minimum temperature of about 200° C. or less near an exit of the exhausting passage 6. If the gas sensor 8 is required to operate at a high temperature, there arise various disadvantages such as decrease in reliability, difficulty in lead connection, thermal oxidation and others. This causes the fact that the atmosphere temperature around the gas sensor 8 is preferable to be as low as possible. In practice, further taking into account the design feasibility of the cooking oven, the gas sensor 8 is placed at a position of less-than 300° C.

A preferred gas sensor 8 is a humidity sensor, more preferably an absolute humidity sensor because the relative humidity in the exhausting passage 6 is so low that the detection may be difficult due to a high atmosphere temperature of 200 to 300° C. around the humidity sensor. In addition, the absolute humidity sensor is preferable to operate even under the condition of a high temperature more than 300° C. because of placing it at the position of less-than 300° C. As a typical absolute humidity sensor is used an absolute humidity sensor of the type comprising a $ZrO_2$-MgO ceramic plate having first and second opposite surfaces whereon $RuO_2$ electrode films are formed, which $ZrO_2$-MgO absolute humidity sensor can operate at a high temperature of 500 to 600° C.

Figure 2:
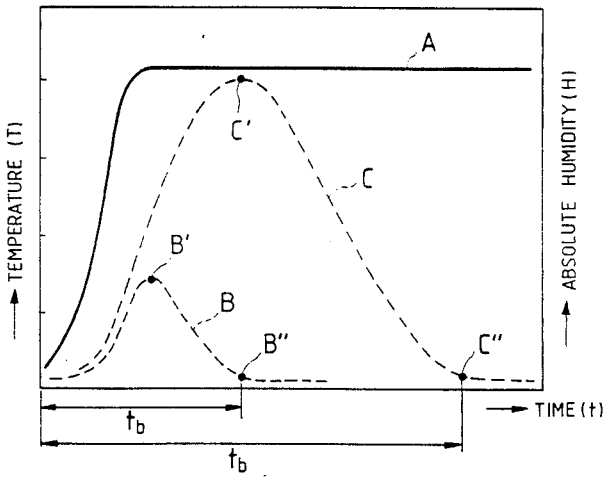
FIG. 2 is a graphic illustration for describing an absolute humidity and a chamber temperature on the basis of a heating time during a self-cleaning process.

FIG. 2 is a graphic illustration of typical absolute humidities on the basis of heating times and further chamber temperatures as a function of the heating times under the condition of using the $ZrO_2$-MgO absolute humidity sensor. Here, the heating time is defined as a heating period after a time whereat a heating energy starts to be supplied through the heating means into the cooking chamber 1. In FIG. 2, the chamber temperature is increased up to the cleaning temperature of about 470° C. for the heating time of about ½ hour and maintained at the cleaning temperature, as indicated by a curve A. The chamber temperature sensor 9 is used in this temperature control in the cooking chamber 1.

With respect to light food soils 15 and heavy food soils 15, variations of the absolute humidity values with the heating time are as indicated by curves B and C, respectively. That is, the absolute humidity values in terms of the light and heavy food soils are initially increased so as to respectively arrive at the maximum concentrations of about 15 g/m$^3$ and about 60 g/m$^3$ indicated by points B' and C' after the heating times of about 40 and 80 minutes. Thereafter, the absolute humidity values begin to be inversely decreased to reach a predetermined initial absolute humidity value of about 10 g/m$^3$ indicated by points B'' and C'' after the heating time periods of 1 hour and 2.5 hours, respectively. That is, in response to start of increase in the chamber temperature, the degrading rate of the food soils 15 increases with increase of the chamber temperature at the beginning of heating and, because to generation of water vapor due to the catalytic oxidation of the degraded products 16, the absolute humidity also increases with increase of the degrading rate of the food soils 15. On the other hand, in the intermediate stage after heating for a given time period at the cleaning temperature, the degrading rate inversely decreases and hence the absolute humidity also decreases, because the amount of the food soils 15 decreases with the increase of the heating time in accordance with progress of pyrolytic degradation. In the final heating stage, generation of vapors is terminated in response to the food soils 15 being completely degraded with a little residue, thereby causing the absolute humidity to arrive at the initial low value.

From the above, it is clear that the initial heating periods $t_b$, corresponding to the inflection points B'' and C'', can be determined on the basis of signals from an absolute humidity sensor. Although the food soils 15 are removed mostly after lapse of the intial heating periods $t_b$ of 1 hour for the light food soils and 2.5 hours for heavy food soils, respectively, a little food soil 15 residue remains residued on the walls 2 so as to be difficult to be cleaned by wiping after cooling. However, it was found that, if a heating period $t_a$ of about ½ hour for both the light and heavy food soils 15 is continuously added after lapse of the initial heating period $t_b$, the residued food soil 15 can completely be cleaned by light wiping after cooling. Thus, the complete cleaning of the food soils 15 is effected with heating for a time period which is the sum of the initial heating period $t_b$ and the additional heating time $t_a$.

As described above, even in the case of the light food soils 15, although a little food soils 15 are still residued on the walls 2 to be difficult to be cleaned by light wiping after cooling, since the little residue of the light food soils 15 are not harmful to practical normal cooking, it is appropriate to stop the heating energy to the cooking chamber 1 after elapse of the initial heating period $t_b$ of about 1 hour. In this self-cleaning process, since a time of ½ hour is required as a cooling time, the cleaning time becomes about 1.5 hours at a minimum and becomes about 2.0 hours by addition of the additional heating time of ½ hour in cases where the little residue food soils 15 are further required to be cleaned by light wiping after cooling. Also in the case of the heavy food soils 15, the cleaning time can be determined by the same manner as described in the case of the light food soils 15.

As another typical gas sensor are known oxygen sensors such as a Volta cell type oxygen sensor and a limiting current type oxygen sensor which can operate in an atmosphere of a high temperature creates 200° C. The former oxygen sensor is not suitable for this apparatus because of requiring a reference gas including a given amount of oxygen, whereas the latter oxygen sensor is suitable for this apparatus because it requires no reference gas and has an excellent linearity. Since the oxygen sensor is disposed at the same position as the absolute humidity sensor in the exhausting passage 6, the oxygen sensor is also preferable to operate at a high temperature more than 300° C.

Figure 3:
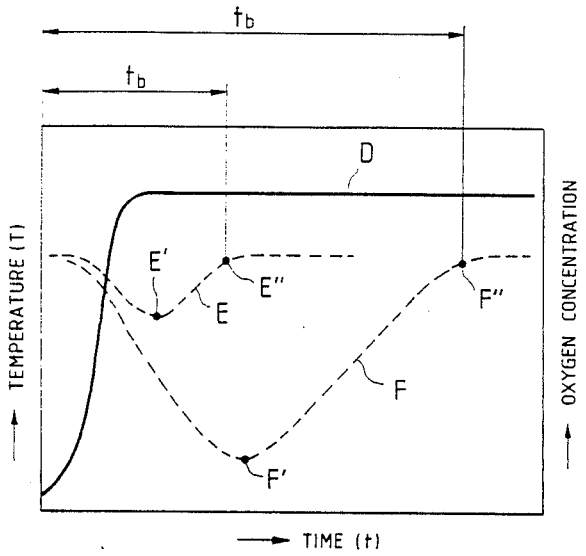
FIG. 3 is a graphic illustration for describing an oxygen concentration and a chamber temperature on the basis of a heating time during a self-cleaning process.

By using the limiting current type oxygen sensor as the gas sensor 8, typical oxygen concentrations based upon the heating time were measured during the self-cleaning process and the results are as shown in FIG. 3, which also shows the relation between the chamber temperature and the heating time. Here, the chamber temperature indicated by a curve D is controlled so as to be substantially the same as the chamber temperature indicated by the curve A in FIG. 2.

In the case of light food soils 15 and heavy food soils 15, the oxygen concentrations are varied in accordance with the heating time as incdicated by curves E and F, respectively. The oxygen concentrations are respectively decreased at initial stage from the initial concentration of about 21% and then arrived at the minimum concentrations of about 20% and about 11% (indicated by points E′ and F′) after the heating time periods of about 40 and 80 minutes, respectively. Thereafter, the oxygen concentrations begin to inversely increase and arrived at the initial concentration (indicated by inflection points E″ and F″) after the heating time periods of about 1 hour and about 2.5 hours (indicated by characters $t_b$), respectively. These behaviors of the oxygen concentrations indicated by the curves E and F are similar in process to that of the absolute humidity sensor described in FIG. 2. In other words, oxygen to be consumed and humidity to be generated are attributed to the same catalytic oxidation of the degraded products 16. Consequently, the curves E and F in FIG. 3 are symmetrical in configuration to the curves B and C in FIG. 2, respectively. This fact indicates that the cleaning time is also controllable by the oxygen sensor in the same manner as described hereinbefore in conjunction with the absolute humidity sensor.

Figure 4:
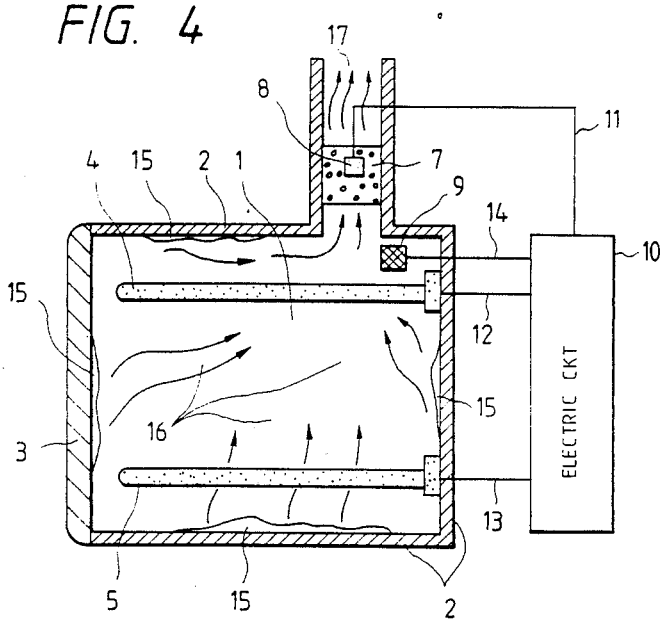
FIG. 4 is a cross-sectional view showing a cooking oven according to another embodiment of the present invention.

Here, since in fact the degraded products 16 are oxidized in the oxidizing catalyst 7, it is also appropriate to place the gas sensor 7 in the oxidizing catalyst 7 as shown in FIG. 4. In this case, there are obtained heating time-to-absolute humidity or oxygen concentration characteristic similar to that shown in FIG. 2 or 3. Although, since the inner temperature of the oxidizing catalyst 7 becomes a high temperature of 600° C. or more, the gas sensor 8 is required to operate at the high temperature of 600° C. or more, the $ZrO_2$-MgO absolute humidity sensor and the limiting current type oxygen sensor can operate at 500 to 600° C. and 400 to 1000° C., respectively, to be available in this arrangement.

Figure 5:
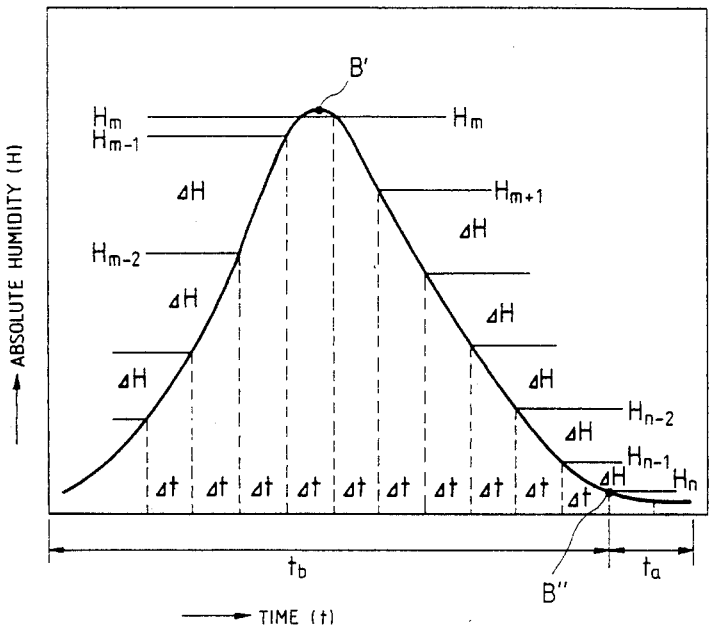
FIG. 5 shows the relation between an absolute humidity and a heating time for describing the principle and operation to determine an inflection point.
Figure 6:
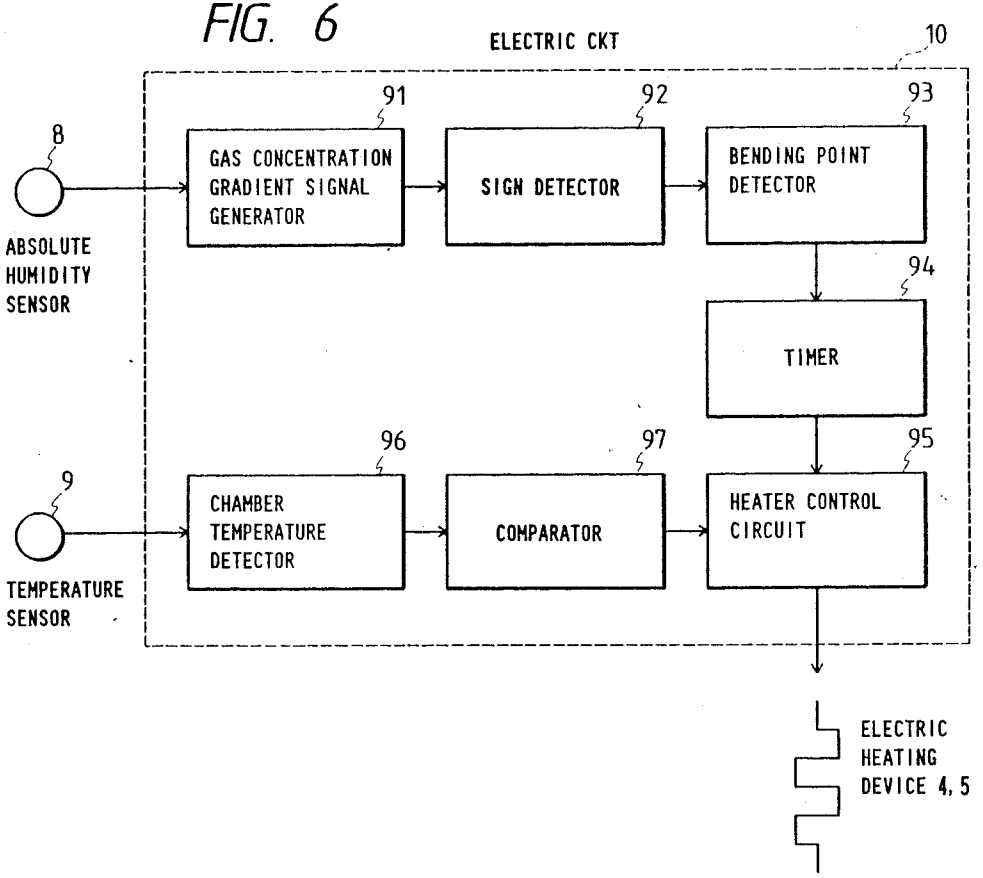
FIG. 6 is a block diagram illustrating an electric circuit for controlling a cleaning time.

FIG. 5 is a graphic illustration for describing a method of detection of the inflection points obtained when the absolute humidity sensor is used as the gas sensor 8 and FIG. 6 is a block diagram showing an arrangement of the electric circuit 10. In this method, the absolute humidity H is sampled at every timing of a given time interval Δt by means of a gas concentration gradient signal generator 91 of the electric circuit 10. An absolute humidity gradient signal ΔH is given in accordance with an equation of $\Delta H = H_m - H_{m-1}$ where $H_m$ is a $n^{th}$ sampled absolute humidity. When $\Delta H = H_m - H_{m-1} \leqq 0$, it is found by a sign detector 92 that the absolute humidity is varying from increasing to decreased through the maximum absolute humidity value indicated by a point B′ in FIG. 5. With subsequent detection of the negative gradient signal ΔH, when ΔH becomes larger than a predetermined negative reference $\Delta H_o$ as the following equation:

$\Delta H = H_n - H_{n-1}$, where $H_n$ is the $n^{th}$ sampled absolute humidity value and $n >> m$, the corresponding point is determined to be the inflection point B″ by a bending point detector 93.

When a little residue of food soils 15 are needed to be cleaned by light wiping after cooling, the additional heating time $t_a$ is set by a timer 94 to be generally about ½ hour. It is also appropriate that the additional heating time $t_a$ is determined in conjunction with the initial heating time $t_b$ necessary for detection of the inflection point B″ in FIG. 5 after the beginning of heating. For example, the additional heating time $t_a$ can be determined as $t_a = kt_b$ where k is a constant. In response to elapse of the additional heating time $t_a$, a heater control circuit 95 stops supply of heating energy to the electric heating devices 4 and 5.

Here, the chamber temperature during the self-cleaning process is controlled as follows. That is, initially, a heating energy is supplied to the electric heating devices 4, 5 so that the chamber temperature slowly increases. The chamber temperature is measured through the chamber temperature sensor 9 by means of a chamber temperature detector 96 and the measured chamber temperature is compared with a predetermined cleaning temperature by a comparator 97. In accordance with the output signal of the comparator 97, the heater control circuit 95 controls supply of heating energy to the electric heating devices 4, 5. The heater control circuit 95 is preferable to be arranged such that the heater current is successively adjusted in accordance with the firing angle of a thyristor, because of allowing to obtain even an extremely small electric power. It is also appropriate to simply performing the adjustment by using an on-off relay circuit. The chamber temperature is maintained at the cleaning temperature until the heating energy supply is stopped after elapse of the additional heating time $t_a$.

Figure 7:
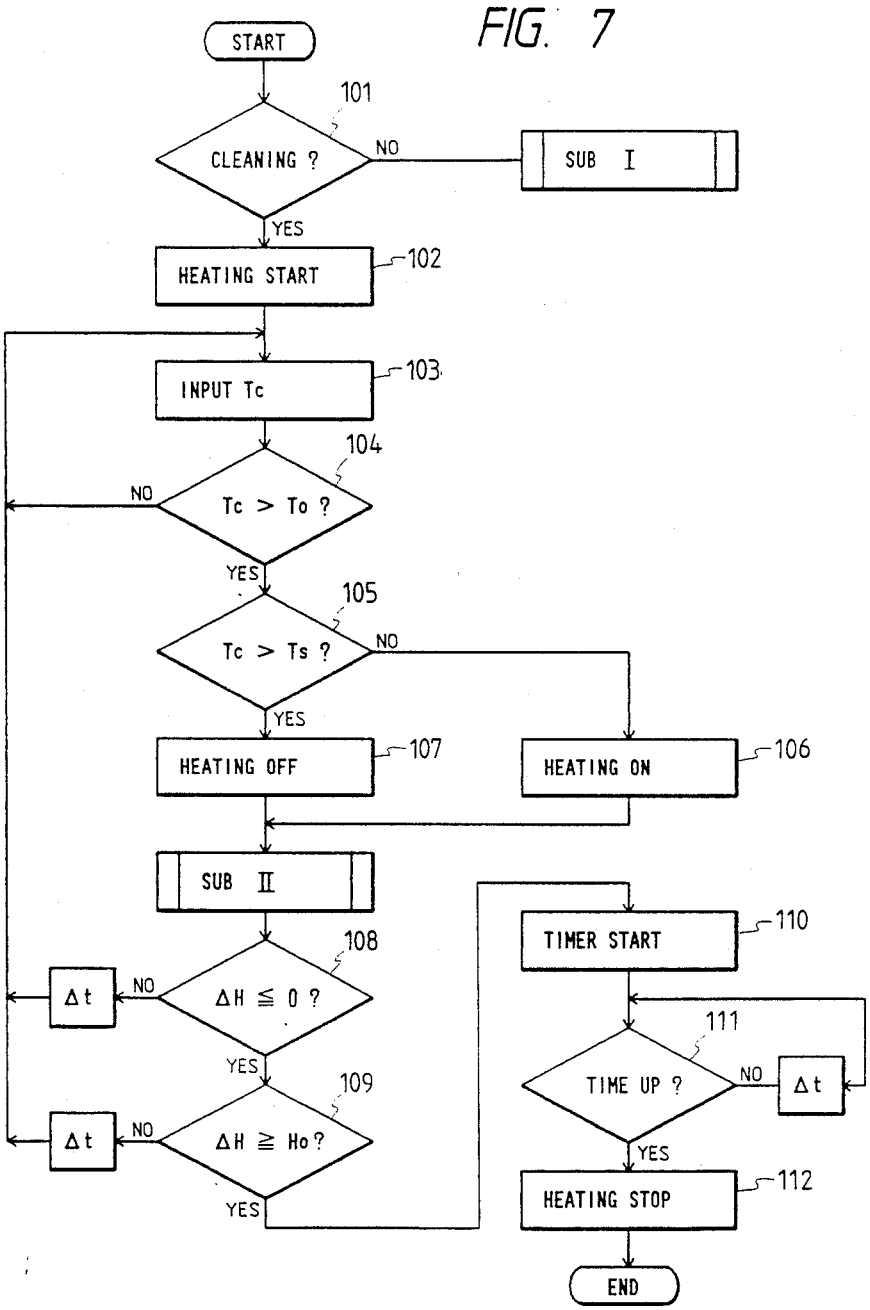
FIG. 7 is a flow chart for describing an example of the cleaning time control operation.

The electric circuit 10 may be constructed by a known microcomputer including a central processing unit (CPU), memories (ROM, RAM) and the associated units in order to realize the aforementioned operation. FIG. 7 is a flow chart illustrating the operation to be executed by the microcomputer under the condition of using the absolute humidity sensor as the gas sensor 8.

In the flow chart of FIG. 7, a block "Sub I" designates a subroutine for a normal cooking process, and a block "Sub II" represents a subroutine for determining the absolute humidity gradient signal ΔH defined by the equation of $\Delta H = H_m - H_{m-1}$ (or $\Delta H/\Delta t = (H_m - H_{m-1})/\Delta t$, where Δt is the sampling time interval). In response to requirement of the self-cleaning process, a button for the process is manually and selectively operated at the beginning (step 101) to thereby start to supply heating energy to the electric heating devices 4 and 5 (step 102). The chamber temperature Tc is detected through the chamber temperature sensor 9 and inputed into the electric circuit 10 (step 103). The chamber temperature Tc is repeadedly detected until it exceeds a reference temperature To (step 104). This is for preventing a malfunction due to vapors in no connection with the catalytic oxidation of the degraded products 16. That is, there are vapors attributed to vaporization of the condensed water and accidentally flied water on the walls 2 from a kitchen and, taking into account the fact that such water is completely vaporized until the chamber temperature Tc increases to a temperature lower than 200° C., the reference temperature To is preferably set to be about 200° C.

When satisfying the condition of $Tc \geqq To$, the control advances to a subsequent stage to check whether the chamber temperature Tc is higher than the cleaning temperature Ts or not (step 105). If $Tc < Ts$, the heating energy is still supplied to the electric heating devices 4, 5 (step 106), and if $Tc \geqq Ts$, the supply of the heating energy thereto is stopped (step 107). Thereafter, the control proceeds to the block of Sub II to detect the absolute humidity gradient signal ΔH. As described hereinbefore with reference to FIG. 5, the absolute humidity H is measured at every sampling timing whose interval is Δt and the gradient signal ΔH defined as the equation $\Delta H = H_m - H_{m-1}$ is issued from the gas concentration gradient signal generator 91. The sign of the gradient signal ΔH is decided by the sign detector 92 (step 108). If $\Delta H > 0$, the operational flow returns to the step 103 after elapse of the time interval Δt. If $\Delta H \leqq 0$, it is decided by the bending point detector 93 in the next process whether or not the negative gradient signal ΔH is larger than a negative reference gradient signal ΔHo (109). If $\Delta H < \Delta Ho$, the operational flow again returns to the step 103 after elapse of the time interval Δt. If $\Delta H > \Delta Ho$ is first satisfied which indicates the inflection point B", a timer is started to count the additional heating time $t_a$ (step 110). After elapse of the additional heating time $t_a$ (step 111), the heater control circuit 95 stops to supply the heating energy to the electric heating devices 4, 5 (step 112).

Although in the above description the cleaning operation is based upon the inflection point B" shown in FIGS. 5, 6, 7, it is also appropriate to effect the cleaning operation on the basis of the maximum absolute humidity point B' in FIG. 5. For example, the additional heating time $t_a$ can be determined in accordance with an equation of $t_a = k't_m$ where k' is a constant and $t_m$ is the heating time period necessary for the maximum absolute humidity to be obtained from the beginning of heating.

On the other hand, as described above with reference to FIG. 3, the oxygen sensor is also preferable as the gas sensor 8. Since the oxygen concentration as a function of the heating time is symmetrical in configuration to the absolute humidity on the basis of the heating time, the same process as described in FIGS. 5, 6 and 7 can be substantially available. In this process, the comparison of the chamber temperature Tc with the reference temperature To is not necessary because of consumption of only the oxygen in connection with the catalytic oxidation of the degraded products 16, thereby resulting in a simpler process as compared with the process using the absolute humidity sensor.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention. For example, although in the above-mentioned embodiments the oxidizing catalyst is provided in the exhausting passage, it is also appropriate that the gas and orthers produced in the cooking chamber are detected directly by means of the gas sensor without providing the oxidizing catalyst so as to control the electric heating devices on the basis of signals from the gas sensor.

What is claimed is:

1. A self-cleaning type cooking oven having a function to pyrolytically eliminate food soils accumulated therein, said cooking oven comprising:

a cooking chamber;

heating means for supplying heat into said cooking chamber so as to allow pyrolytic degradation of the food soils accumulated on walls of said cooking chamber;

an exhausting passage coupled to said cooking chamber to exhaust gases generated due to the pyrolytic degaradation in said cooking chamber to an ambient atmosphere;

an oxidizing catalyst provided in said exhausting passage to oxidize said gases passing therethrough;

gas sensor means provided in said exhausting passage to detect a gas component therearound and arranged to generate a gas signal indicative of the amount of said gas component;

temperature sensor means provided in said cooking chamber so as to generate a temperature signal indicative of a temperature of said cooking chamber; and heat control means electrically connected to said heating means for controlling supply of heat into said cooking chamber, said heat control means being responsive to said gas signal from said gas sensor means and said temperature signal from said temperature sensor means so as to maintain a temperature of said cooking chamber up to a predetermined cleaning temperature and to determine a heating time period of said cooking chamber for cleaning, said heat control means sampling said gas signal at a predetermined time interval to detect a variation of the amount of said gas component and detect a first inflection point from increasing to decreasing or vice versa in the gas-component variation and a second inflection point from decreasing to increasing or vice versa in the gas-component variation after detection of said first inflection point to determine said heating time period in correspondance with said second inflection point.

2. A self-cleaning type cooking oven as claimed in claim 1, wherein said gas sensor means is provided downstream of said oxidizing catalyst in said exhausting passage so that said gas in said cooking chamber first contacts with said oxidizing catalyst and then contacts with said gas sensor means when exhausted through said exhausting passage.

3. A self-cleaning type cooking oven as claimed in claim 2, wherein said gas sensor means is an absolute humidity sensor.

4. A self-cleaning type cooking oven as claimed in claim 3, wherein said absolute humidity sensor is disposed at a position around which an atmosphere temperature is lower than 300° C.

5. A self-cleaning type cooking oven as claimed in claim 2, wherein said gas sensor means is an oxygen sensor.

6. A self-cleaning type cooking oven as claimed in claim 5, wherein said oxygen sensor is a limiting current type sensor.

7. A self-cleaning type cooking oven as claimed in claim 1, wherein said gas sensor means is placed in said oxidizing catalyst.

8. A self-cleaning type cooking oven having a function to pyrolytically eliminate food soils accumulated therein, said cooking oven comprising:

a cooking chamber;

heating means for supplying heat into said cooking chamber so as to allow pyrolytic degradation of the food soils accumulated on walls of said cooking chamber;

an exhausting passage coupled to said cooking chamber to exhaust gases generated due to the pyrolytic degradation in said cooking chamber to an ambient atmosphere;

an oxidizing catalyst provided in said exhausting passage to oxidize said gases passing therethrough;

gas sensor means provided in said exhausting passage to detect a gas component therearound and arranged to generate a gas signal indicative of the amount of said gas component;

temperature sensor means provided in said cooking chamber so as to generate a temperature signal indicative of a temperature of said cooking chamber; and heat control means electrically connected to said heating means for controlling supply of heat into said cooking chamber, said heat control means being responsive to said gas signal from said gas sensor means and said temperature signal from said temperature sensor means so as to maintain a temperature of said cooking chamber up to a predetermined cleaning temperature and to determine a heating time period on the basis of the amount of said gas component indicated by said gas signal so that said cooking chamber is heated for said heating time period whereby the food soils accumulated on said walls of said cooking chamber is substantially degraded during said heating time period, said heat control means including:

first means responsive to said gas signal at a predetermined time, interval so as to generate a signal indicative of variation of the amount of said gas component;

second means for detecting a changing point from increasing to decreasing or vice versa in the variation of the amount of said gas component on the basis of said variation signals from said first means; and third means for detecting a second changing point from decreasing to increasing or vice versa in the variation of said gas component after the detection of said first-mentioned changing point, wherein said heat control means determines said heating time period on the basis of said second changing point detected by said third means.

9. A self-cleaning type cooking oven as claimed in claim 8, wherein said heat control means additionally and successively supplies heating energy to said heating means for a predetermined time period after lapse of said heating time period.

* * * * *